US011145266B2

(12) United States Patent
Hsu et al.

(10) Patent No.: US 11,145,266 B2
(45) Date of Patent: Oct. 12, 2021

(54) METHOD AND CIRCUIT FOR VIEWING ANGLE IMAGE COMPENSATION

(71) Applicant: REALTEK SEMICONDUCTOR CORP., Hsinchu (TW)

(72) Inventors: Wei-Yuan Hsu, Taoyuan (TW); Hsiu-Yun Chang, Taoyuan (TW)

(73) Assignee: REALTEK SEMICONDUCTOR CORP., Hsinchu (TW)

( * ) Notice: Subject to any disclaimer, the term of this patent is extended or adjusted under 35 U.S.C. 154(b) by 0 days.

(21) Appl. No.: 17/014,739

(22) Filed: Sep. 8, 2020

(65) Prior Publication Data

US 2021/0074229 A1 Mar. 11, 2021

(30) Foreign Application Priority Data

Sep. 10, 2019 (CN) ..... 201910854905.8

(51) Int. Cl.
*G09G 3/36* (2006.01)

(52) U.S. Cl.
CPC ..... *G09G 3/3607* (2013.01); *G09G 2320/028* (2013.01); *G09G 2320/0242* (2013.01); *G09G 2340/06* (2013.01); *G09G 2360/16* (2013.01)

(58) Field of Classification Search
CPC ..... G09G 2320/028; G09G 2320/0242
See application file for complete search history.

(56) References Cited

U.S. PATENT DOCUMENTS

2004/0246267 A1* 12/2004 Oohara ..... H04N 1/6005 345/591
2012/0147067 A1* 6/2012 Hashimoto ..... G09G 3/3611 345/690
2014/0118423 A1* 5/2014 Hasegawa ..... G09G 3/3607 345/690
2017/0053579 A1* 2/2017 Chen ..... G09G 5/04

* cited by examiner

*Primary Examiner* — Roy P Rabindranath
(74) *Attorney, Agent, or Firm* — Li & Cai Intellectual Property (USA) Office

(57) ABSTRACT

A method and a circuit for viewing-angle image compensation applied to a flat panel display are provided. A viewing-angle image compensation scheme is applied to an input image for improving a problem of color shift caused by a large viewing angle. The method further solves the blur effect in high frequency regions and color bleeding in low saturation regions of the input image after viewing-angle image compensation. In the method, a frequency distribution of the input image is detected and decremental frequency weights are assigned to the regions having high to low frequencies. A saturation distribution of the input image is detected and incremental saturation weights are assigned to the regions having high to low saturations. The weights assigned to the regions are used to designate degrees of the viewing-angle image compensation. The method can effectively reduce the effect of the viewing-angle image compensation on the image.

18 Claims, 7 Drawing Sheets

METHOD AND CIRCUIT FOR VIEWING ANGLE IMAGE COMPENSATION

CROSS-REFERENCE TO RELATED PATENT APPLICATION

This application claims the benefit of priority to Patent Application No. 201910854905.8, filed on Sep. 10, 2019 in People's Republic of China. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The disclosure is generally related to a technology of viewing-angle image compensation, and more particularly to a method and a circuit for viewing-angle image compensation that can solve a blur problem in high-frequency region and color bleeding in low-saturation region when performing viewing-angle image compensation.

BACKGROUND OF THE DISCLOSURE

Types of LCD panels adopted by a flat panel display are such as a twisted nematic (TN) type liquid crystal, a vertical alignment (VA) type liquid crystal, and an in-plane switching (IPS) liquid crystal. In general, both color and contrast of the LCD appear normal from a front view. However, such as the TN and VA panel, the color of a non-front view, i.e., at a larger viewing angle, may have color shift that causes low display contrast. The color shift and low contrast causes a poor viewing experience, especially at larger viewing angles. Conventional technologies have provided several solutions to compensate the viewing effect at large viewing angles.

FIG. 1 shows a schematic diagram depicting the image defects at different viewing angles. A flat display picture 10 is shown. In general, a display screen can provide a good-quality display picture for a user at an orthographic direction, i.e., at a second viewing-angle 102. However, when the user views the display picture at a direction with a larger viewing-angle, i.e., at a first viewing-angle 101 or a third viewing-angle 103, the user may see image defects at the flat display picture 10 or boundaries of the image. The defects are such as declined luminance and saturation. The defects stem from reasons of color shift and low saturation.

According to one of the conventional technologies for viewing-angle image compensation applied to a display, the subpixels of a region such as an area with large viewing angle are separated into multiple groups. The subpixels that require viewing-angle image compensation are the red, green and blue subpixels. Every group consists of multiple subpixels. The original sequentially-arranged subpixels are then driven to display in an arrangement alternating between bright and dark, so as to compensate for color shift that occurs in a large viewing-angle region, as illustrated in FIG. 2.

FIG. 2 shows a schematic diagram depicting subpixels 201 to 218 within a display region of a flat panel display. The subpixels 201 to 218 are sequentially arranged in a sequence of red, green and blue. A pixel consists of a set of red, green and blue subpixels. In the conventional technology of viewing-angle image compensation, the sequentially-arranged subpixels 201 to 218 within the display region are rearranged in a sequence alternating between bright and dark so as to have the pixel values of each color channel adjusted. For example, if the values of the subpixels 201 to 218 are 50, the upper subpixel 201 can be adjusted to 70, the adjacent subpixels 202 can be adjusted to 20, the subpixel 203 can be adjusted to 70, and so on. The lower subpixel 210 can be adjusted to 20, the subpixel 211 can be adjusted to 70, and so on. Therefore, the subpixels 201 to 218 within the display region are in an arrangement that alternates between bright and dark subpixels, so that the color shift due to the large viewing angle can be reduced.

However, the conventional technologies of viewing-angle image compensation still have other shortcomings such as blur effect that occurs to the boundaries of an object within the high-frequency display region and such as color bleeding formed in the low-saturation display region.

SUMMARY OF THE DISCLOSURE

The disclosure is related to a method for viewing-angle image compensation and a circuit that is applied to the situations such as color shift, blur and color bleeding occurring on a display picture. In the method, the display region of an image requiring compensation can be obtained through detection of frequency and saturation of the image. Further, various weights are assigned to the display regions for generating pixel values with compensation. Therefore, the viewing-angle image compensation can be done, while concurrently solving the blur at the high-frequency region and color bleeding at the low-saturation region.

According to one embodiment of the disclosure, in the method for viewing-angle image compensation, a frequency distribution of an input image having display regions is firstly detected, and different frequency weights are assigned to the display regions according to the frequencies of the display regions ranging from a high-frequency display region to a low-frequency display region. For example, the frequency weights can be assigned to the display regions decrementally. Further, a saturation distribution of the input image can be detected, and different saturation weights are assigned to the display regions from a high-saturation display region to a low-saturation display region. For example, the saturation weights are assigned to the display regions incrementally. After that, according to the frequency weights and the saturation weights assigned to the display regions, the degrees for performing viewing-angle image compensation on each of the display regions of the input image can be adjusted. An output image is then generated after performing mixing-weight mapping on the image being processed with the viewing-angle image compensation.

For performing viewing-angle image compensation on each of the display regions of the input image, luminance of pixels of a first buffered image from the input image, a second buffered image and a third buffered image can be obtained. After that, a first absolute value of a luminance difference between the first buffered image and the second buffered image and a second absolute value of another luminance difference between the second buffered image and the third buffered image can be obtained. A sum of the first absolute value and the second absolute value is regarded as a frequency value of a display region of the input image.

Thus, by assigning the frequency weights, the high-frequency display region of the input image is not processed with the viewing-angle image compensation for effectively reducing the blur effect upon the high-frequency display region.

In an aspect of the disclosure, a first buffered image, a second buffered image and a third buffered image are obtained from the input image. The pixel values including the subpixels of the red, green and blue of the input image are obtained so as to calculate absolute values of differences of the pixel values of the red, green and blue among the first buffered image, the second buffered image and the third buffered image. After that, a largest difference of the differences can be used as a saturation value for each of the display regions.

Still further, by assigning the frequency weights, the low-saturation display region of the input image is not processed with the viewing-angle image compensation for effectively reducing color bleeding in the low saturation regional.

The disclosure is also related to a circuit for driving a display panel and performing viewing-angle image compensation.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
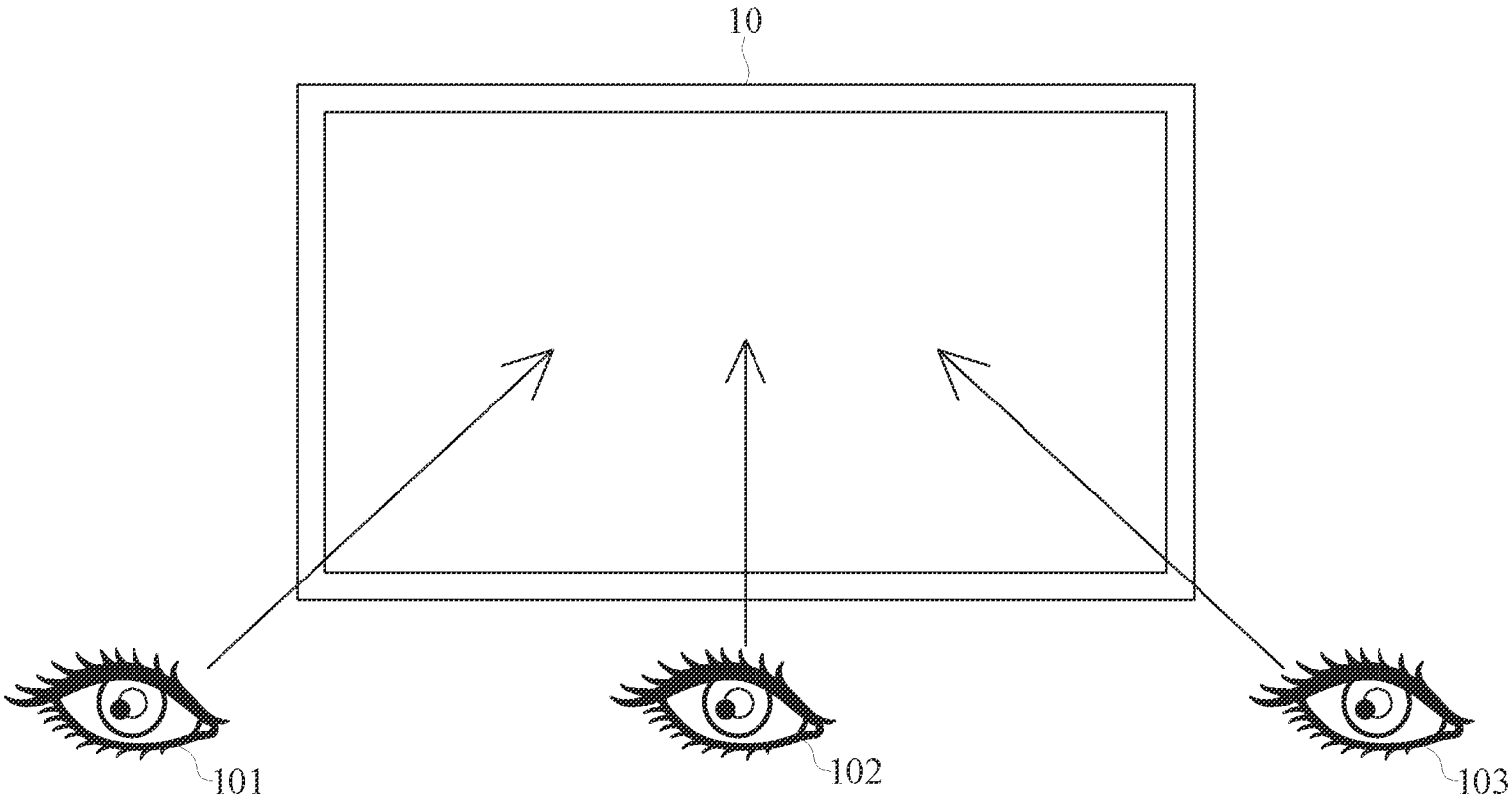
FIG. 1 (RELATED ART)
FIG. 1 is a schematic diagram depicting image defects at a certain viewing angle of a display.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

A viewing-angle image compensation method is provided to reduce color shift due at different viewing angles of a display picture, especially at a large viewing angle of a display. One of the objectives of the method is to achieve a consistent gamma value for all viewing angles of the display picture. In a conventional process for performing viewing-angle image compensation, subpixels, e.g., subpixels 201 to 218 of pixels in FIG. 2, of a display region are sequentially arranged in alternating bright and dark for reducing color shift at a specific viewing angle especially a large viewing angle. However, even though the subpixels appear to be arranged with various permutations, such as alternating two brightness and two darkness, one brightness and one darkness horizontally, or two brightness and two darkness vertically, for adjusting the pixel values in each of the channels so as to reduce color shift at a specific viewing angle, the display region may still become blurred at boundary of the high-frequency display region or form color bleeding at a low saturation region. In an exemplary example, a chrominance reflects purity of color or saturation that can distinguish degrees of brightness. The low saturation indicates that the pixel values of red, green and blue are close to each other so as form a low-saturation image, i.e., a gray image. The low saturation can be determined by setting up a threshold. When viewing the display picture at a large viewing angle, the conventional viewing-angle image compensation may cause uneven red, green and blue colors after adjusting the brightness and darkness of the subpixels. Further, the conventional viewing-angle image compensation may also result in color bleeding at the boundary of low-saturation region, or severe graininess at the non-boundary region.

When a specific object is displayed on a display screen, a boundary of the object can be used to recognize a definition of the image. The conventional viewing-angle image compensation method is performed for adjusting brightness of the subpixels. The adjustment of brightness of the subpixels improves the color shift at a large viewing angle. The definition of the image declines because multiple pixels are required to achieve one single pixel. The definition of the boundary may decline and blur occurs at the boundary.

The present disclosure is related to a method of viewing-angle image compensation and a circuit thereof. The method is regarded as a compensation solution used for improving the defects of a display picture such as color shift, blur and/or color bleeding. The defects may particularly occur when viewing the display picture at a relatively large viewing-angle. The circuit can be an integrated circuit (IC) or a control circuit that is implemented by circuit logistics and can operate using software approach for performing viewing-angle image compensation, such as Field Programmable Gate Arrays (FPGAs). The circuit logistics implement a driving circuit of a display panel and is capable of improving the defects such as color shift, blur or color bleeding that may occur at a large viewing-angle.

The method of viewing-angle image compensation can be adapted to an input image received by the circuit. A display region to be compensated can be designated by performing frequency detection and saturation detection upon the input image. The method relies on different defects to assign various weights to the pixels of the input image for the compensation method. The color shift can be improved through the method of viewing-angle image compensation, and both the blur effect in a high-frequency display region and the color bleeding in a low-saturation display region can also be solved at the same time.

Figure 3:
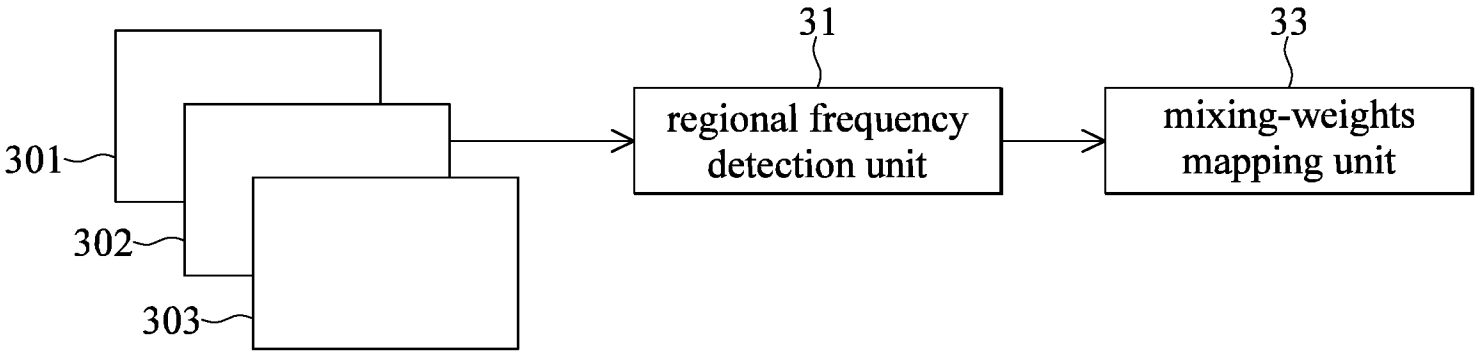
FIG. 3 is a schematic diagram depicting the method for viewing-angle image compensation being performed on a region with a specific frequency in one embodiment of the disclosure.

Reference is made to FIG. 3, which shows a schematic diagram depicting the method of viewing-angle image compensation being applied to a region with a specific frequency according to an embodiment of the disclosure.

A circuit shown in the diagram includes a regional frequency detection unit 31 and a mixing-weight mapping unit 33 that are implemented by circuit logistics. The circuit receives image data from an image source. The circuit may only receive data with a size of a line buffer at a time according to design of the line buffer. When the method of viewing-angle image compensation is performed on the pixels over a line, the pixel values of the other pixels over the adjacent lines are also required so as to render a first buffered image 301, a second buffered image 302 and a third buffered image 303. These buffered images can be the image data in a current line buffer (CurLine), the image data in a previous line buffer (PreLine) and the image data in a next line buffer (NextLine) respectively.

The circuit then receives the first buffered image 301, the second buffered image 302 and the third buffered image 303. If the image is within an RGB color space, besides being able to determine the image frequency according to the signals being mixed with red, green and blue colors, the image frequency can also be determined when the image is within other color space such as YUV color space or HIS color space. For example, the image can be converted to a YUV color space that is defined in terms of one luminance (Y) component and two chrominance (U, V) components, and the image frequency can be determined according its YUV components. In YUV color space, the Y value denotes a gray value of an image. In the meantime, a regional frequency detection unit 31 is introduced in the circuit and can be used to obtain a frequency value with respect to every pixel.

When the luminance of a pixel is referred to for calculating the frequency value, the values of the pixel and its adjacent pixels can be obtained from the input image. One of the methods is to calculate a first absolute value of a difference (i.e., ABS(PreLineY-CurLineY)) between the luminance (Y) of the first buffered image 301 and the luminance of the second buffered image 302, and a second absolute value of another difference (i.e., ABS(CurLineY-NextLineY)) between the luminance of the second buffered image 302 and the luminance of the third buffered image 303. As shown in equation 1, a sum of the first absolute value and the second absolute value is the frequency value (FREQ) of the display region of the input image.

$$FREQ=ABS(PreLine\ Y\text{-}CurLine\ Y)+ABS(CurLine\ Y\text{-}NextLine\ Y) \quad \text{Equation 1}$$

In an aspect of the disclosure, equation 1 can be used to detect the high-frequency portion of the input image. The high-frequency portion of the input image is such as the display region that may easily have blur due to the viewing-angle image compensation. Therefore, this display region may not have the viewing-angle image compensation performed, or only undergo slight compensation. It should be noted that a frequency weight is applied for determining or adjusting a degree of viewing-angle image compensation.

In the method of viewing-angle image compensation, the regional frequency detection unit 31 can be used to obtain a difference between the luminance (Y) of every pixel and the luminance of its adjacent pixels. The difference denotes the frequency value of the pixel. Therefore, a frequency distribution with respect to the input image can be obtained. It should be noted that the luminance (Y) in the YUV color space denotes a gray value of the image, and the image frequency obtained by equation 1 indicates a measurement of degree of change in gray scale of the adjacent pixels. For example, the image frequency denotes a difference between absolute values of pixel values within a fixed range, or a degree of change in gray scale within a fixed distance. If it determines a large change in gray scale of the adjacent pixels, the region is regarded as a high-frequency region of the image. The high-frequency region is such as boundary of a specific object or noises thereof. On the contrary, the smaller change in gray scale of the adjacent pixels is regarded as a low-frequency region. A long scene of the image or a region with uniform color may be regarded as the low-frequency region.

The circuit then performs a mixing-weight mapping through a mixing-weight mapping unit 33 that is implemented by a software process with circuit logistics. The mixing-weight mapping unit 33 assigns different weights to the pixels of image based on a frequency value with respect to each of the pixels. In principle, the pixel with a higher image frequency is assigned with a higher weight, and conversely the pixel with a lower image frequency is assigned with a lower weight. When performing the method of viewing-angle image compensation, the lower weights can reduce the influence upon the high-frequency display region. For example, the lower weights can suppress the blur occurring at the high-frequency display region after performing the viewing-angle image compensation. In one embodiment of the disclosure, frequency values of the pixels of an input image can be obtained. The frequency values can be sorted from high frequency to low frequency. The sorting result of the frequency values is referred to for the circuit to divide the display region into multiple regions. The display regions are assigned with high-to-low compensation weights respectively. When one of the display regions is assigned with a highest weight, it indicates that a display region with a highest image frequency and this display region may not be processed by the conventional viewing-angle image compensation. On the contrary, if the display region has the lowest image frequency, a lowest weight is applied since there is low possibility of blur at the large viewing angle. However, a relatively high weight may be applied to the viewing-angle image compensation performed on this display region, and the display region can even be processed completely by the conventional viewing-angle image compensation method.

In an exemplary example, the text portion of an image is generally a bright point or a bright area with a high luminance (Y) value that is much different from the luminance values of its surrounding pixels. The bright area is also a high-frequency region that is assigned with a higher weight for viewing-angle image compensation and is able to prevent blur effect in a conventional viewing-angle image compensation process. The blur effect occurs on the display region when the definition of boundary of an object in the image declines. For example, if the luminance of boundary or contour of an object in the image dramatically changes, it indicates that the boundary or contour of the object is a high-frequency display region that can be assigned with high weights.

Figure 4:
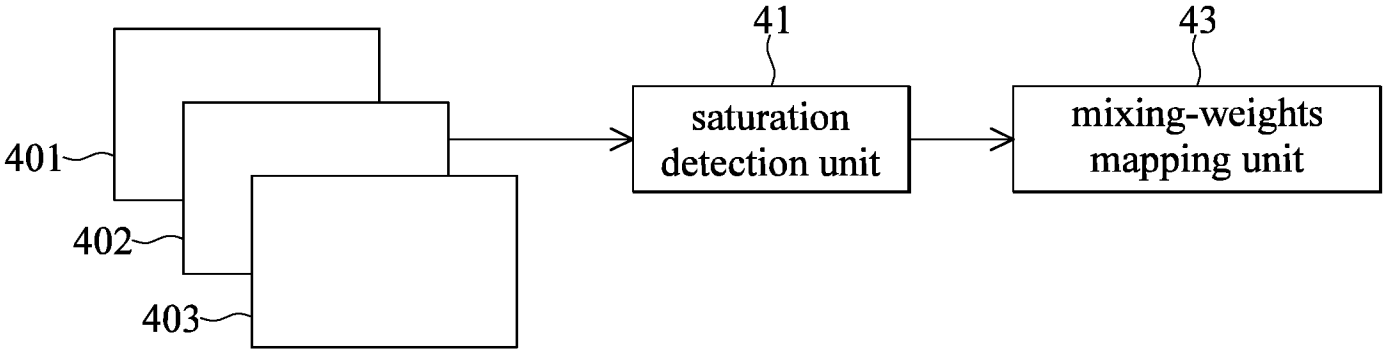
FIG. 4 is a schematic diagram describing a process of saturation detection in the method for viewing-angle image compensation according to one embodiment of the disclosure.

FIG. 4 is a schematic diagram that depicts a scheme of saturation-detection compensation in the method of viewing-angle image compensation in one embodiment of the disclosure.

The saturation of the image is such as a chroma value that can be represented by red, green or blue color. The higher the saturation, the more colorful the image appears to be. On the contrary, the lower the saturation, the closer to gray the color appears to be. For example, a pure color, e.g., pure red, green or blue, has the highest saturation, but the saturation of gray is zero.

In an exemplary example, when the method is performed on the pixels of a line, the circuit firstly obtains a first buffered image 401, a second buffered image 402 and a third buffered image 403. These buffered images in a line buffer include image data of a current line (CurLine), image data of a previous line (PreLine) and image data of a next line (NextLine). Further, when a saturation detection unit 41 that is implemented by a software process being cooperated with circuit logistics performs saturation detection, the pixel values of the input image in RGB color space are used to obtain the values of red, green and blue subpixels of each of the pixels. Therefore, the absolute values of differences are calculated from the red, green and blue pixels among the first buffered image 401, the second buffered image 402 and the third buffered image 403. The absolute values can be regarded as saturation values of the image or the display region.

Figure 2:
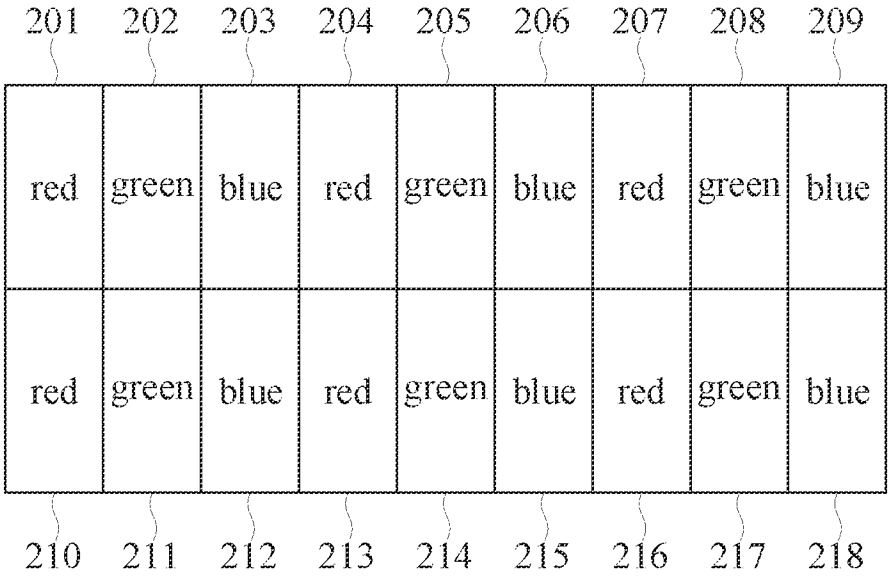
FIG. 2 (RELATED ART)
FIG. 2 is another schematic diagram showing pixels for conventional viewing-angle image compensation method.

One of the methods that can be referred to for obtaining the saturation is equation 2. The arrangement of subpixels of the input image can be as shown in FIG. 2. For obtaining the saturation such as the pixel values of red, green or blue of pixels of the display region, absolute values of the differences between the adjacent subpixels are calculated. The absolute value, i.e., the saturation of the display region, is referred to as a maximum (Max) of ABS(R-G), ABS(R-B) and ABS(G-B) of equation 2.

$$SAT=\mathrm{Max}(\mathrm{ABS}(R-G),\mathrm{ABS}(R-B),\mathrm{ABS}(G-B)) \quad \text{Equation 2}$$

In an aspect of the disclosure, the portion with low saturation of the image obtained in equation 2 is the display region that easily suffers from color bleeding due to the conventional viewing-angle image compensation. Therefore, this portion with low saturation may not be or is slightly processed by viewing-angle image compensation. A saturation weight is used as a level of viewing-angle image compensation.

The circuit uses the saturation detection unit 41 to obtain a saturation distribution of the input image. Since the conventional method of viewing-angle image compensation may suffer from color bleeding in the low-saturation region, a mixing-weight mapping unit 43 can be introduced to assign various compensation weights to the high-saturation display region to low-saturation display region. In one embodiment of the disclosure, the region can be divided into several sections that are assigned with high to low compensation weights. The regions with lowest saturation can be assigned with a highest weight that is used for suppressing the effect of viewing-angle image compensation. The high weight declines the level of viewing-angle image compensation or can even not be processed by the conventional method of viewing-angle image compensation for reducing color bleeding occurring in the low-saturation display region. On the contrary, the display region with a highest saturation may not have color bleeding by the conventional viewing-angle image compensation, and therefore be assigned with a lower weight. The display region with the highest saturation may even be processed by the conventional viewing-angle image compensation.

The method of viewing-angle image compensation of the disclosure can rely on a frequency value and a saturation of the image to assign a blending weight simultaneously. The mixing-weight mapping unit (33, 43) can respectively map the weighted values to the frequency value of the saturation of the original image.

Figure 5:
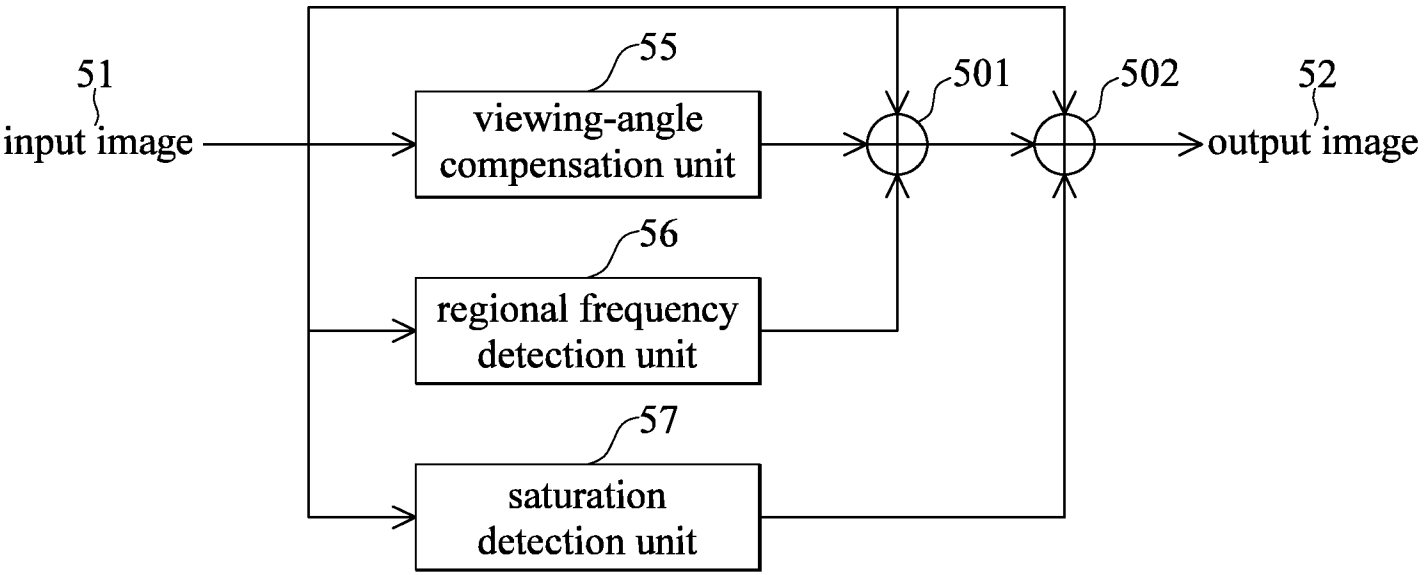
FIG. 5 shows a functional block diagram implementing the method for viewing-angle image compensation in one embodiment of the disclosure.

Reference is made to FIG. 5 showing functional blocks used to describe the software and hardware of a circuit. The weight with respect to the frequency value and saturation is configured to adjust the level of viewing-angle image compensation. The mechanism of weight assignment allows the circuit to suppress blur occurring to the boundary, i.e., the high-frequency region, and the regional color bleeding in the low-saturation region by the conventional viewing-angle image compensation.

According to the functional blocks shown in FIG. 5, an input image 51 is inputted to the circuit that processes the input image 51 via different functional blocks. For example, a viewing-angle image compensation unit 55 performs viewing-angle image compensation upon the input image 51 by the method described in FIG. 2 of the disclosure. The method processes the sequentially-arranged red, green and blue subpixels by a measure of alternating bright and dark. The circuit drives the subpixels of a display in a sequence of alternating bright and dark. For example, the subpixels can be driven as "bright, dark, bright, dark, bright, etc." or "bright, bright, dark, dark, bright, bright, etc." The color shift in the large viewing-angle region can be compensated by the method.

When the input image 51 is inputted to a regional frequency detection unit 56, as shown in the embodiment of FIG. 3, equation 1 is performed to calculate a frequency value of the display region relating to the pixels of the input image 51. After a first mixing-weight mapping unit 501 processes the input image, various weights are assigned to the display regions from high frequency value to low frequency. For example, the display regions can be assigned with decremental weights or incremental weights. The relatively high frequency display region is assigned with higher weight that can reduce the effect of viewing-angle image compensation upon the display region for effectively suppressing blur occurring to this high-frequency display region.

The input image 51 is also inputted to a saturation detection unit 57. As the embodiment depicted in FIG. 4, equation 2 is performed for calculating saturation for the display regions related to the pixels. When a second mixing-weight mapping unit 502 is performed, various weights are assigned to the display regions with high to low saturations. For example, the weights can be assigned to the regions incrementally or decrementally. The high weights are assigned to the low-saturation display region for relatively reducing the effect of viewing-angle image compensation applied to the low-saturation display region, and can effectively suppress regional color bleeding in the same region.

After the input image 51 is processed by the viewing-angle image compensation unit 55, the first mixing-weight mapping unit 501 sets up the weights applied to the display regions according to a frequency distribution. A second mixing-weight mapping unit 502 also sets up the weights applied to the display regions according to a saturation distribution. An output image 52 of the viewing-angle image compensation unit 55 is generated with mixed weights including the weights being adjusted by the regional frequency detection unit 56 through the first mixing-weight mapping unit 501 and the weights being adjusted by the saturation detection unit 57 through the second mixing-weight mapping unit 502. The calculation of the output image 52 can be referred to in equation 3.

$$\text{OUTPUT}=\text{INPUT}*W_{FREQ}+\text{VAC}(\text{INPUT}*(1-W_{FREQ}))+\text{INPUT}*W_{SAT}+\text{VAC}(\text{INPUT}*(1-W_{SAT})) \quad \text{Equation 3}$$

Both $W_{FREQ}$ and $W_{SAT}$ are smaller than 1 and can be a value from 0 to 1. $W_{FREQ}$ and $W_{SAT}$ represent the frequency weights and the saturation weights assigned to the display regions of the input image. Therefore, a degree of the viewing-angle image compensation (VAC) applied to the input image (INPUT) can be adjusted. In equation 3, the frequency weight ($W_{FREQ}$) applied to the display region of the input image 51 (INPUT) is adjusted according to the frequency distribution. Further, the saturation weight ($W_{SAT}$) applied to the display region of the input image 51 (INPUT) is also adjusted according to the saturation distribution. Furthermore, the weight of viewing-angle image compensation for the input image 51 is also adjusted. Finally, the output image 52 with reduced degree of viewing-angle image compensation affecting the high-frequency and low-saturation display region is generated.

Figure 6:
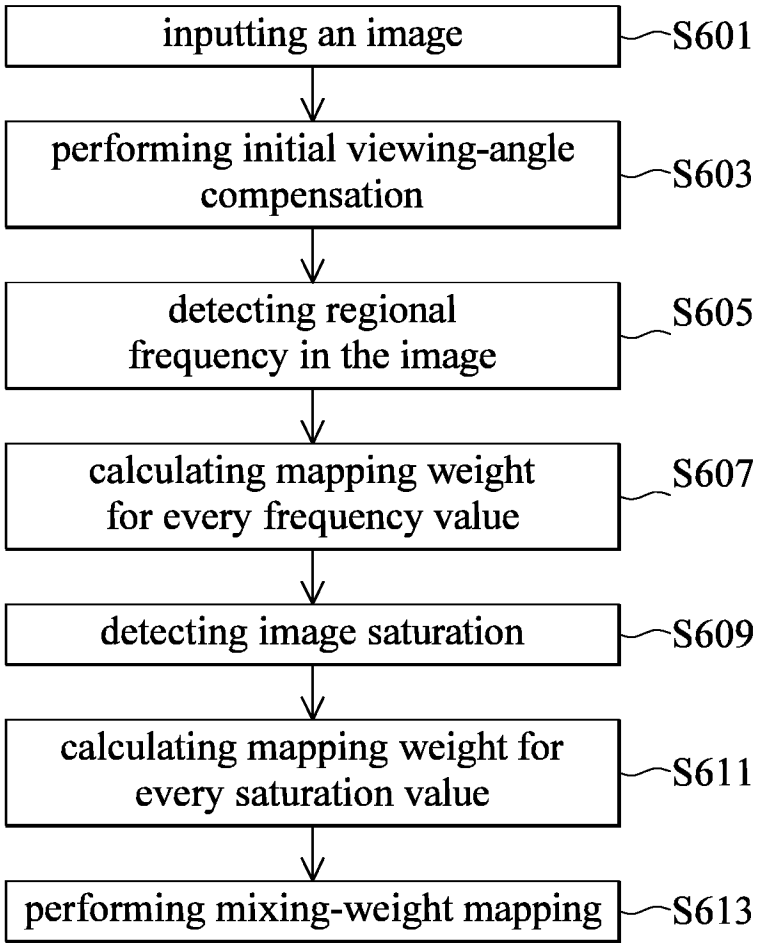
FIG. 6 shows a flow chart describing the method for viewing-angle image compensation in one embodiment of the disclosure.
Figure 7:
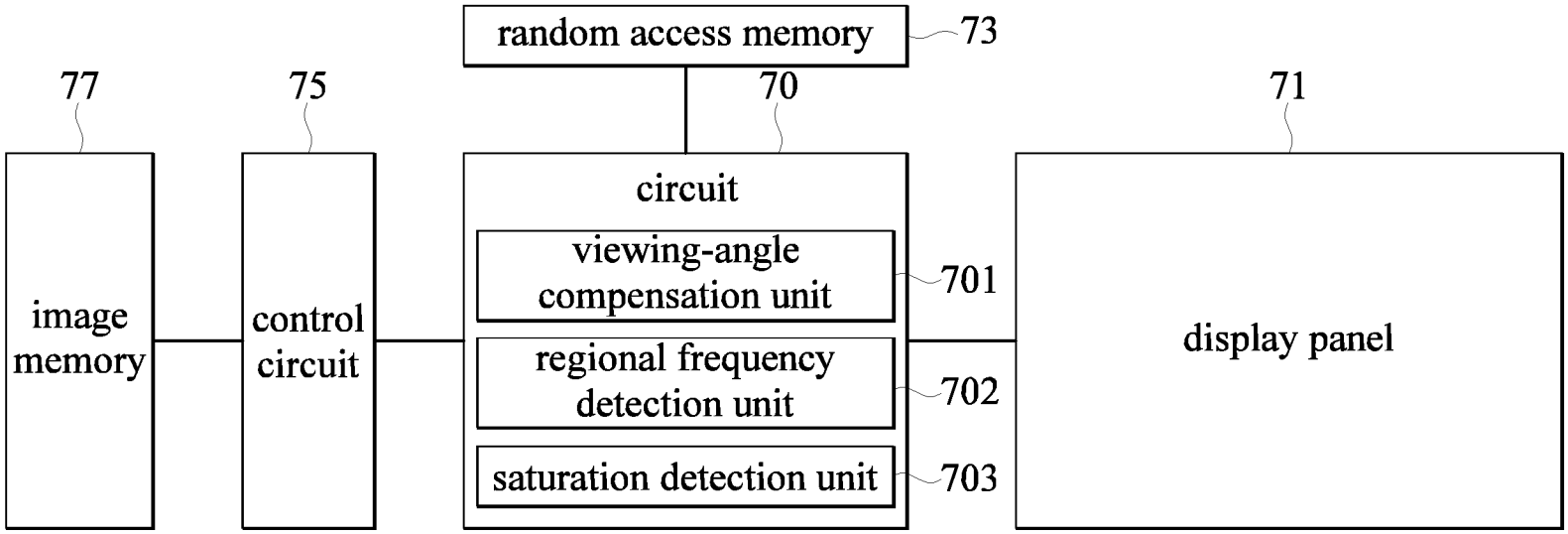
FIG. 7 shows a block diagram of a circuit for implementing the method for viewing-angle image compensation in one embodiment of the disclosure.

The method of viewing-angle image compensation implemented by a circuit is exemplarily described in the flow chart shown in FIG. 6. The circuit implementing the method of the disclosure shown in FIG. 7 can also be referred to. The circuit can be an integrated circuit (IC) or a control circuit that can be implemented by circuit logistics used as a driving circuit of a display panel 71 of the disclosure.

The aspect of the method of viewing-angle image compensation is to reduce the effect of the conventional viewing-angle image compensation performed on the high-frequency display region for preventing blur effect. Further, the method also reduces the effect of the conventional viewing-angle image compensation performed on the low-saturation display region for reducing color bleeding in the low-saturation display region. The weighting mechanism can be applied to configure the degree of viewing-angle image compensation. The weighted values with respect to the frequency and saturation allow the high-frequency display region and the low-saturation display region to reduce the effect of the conventional viewing-angle image compensation. In other words, for the high-frequency display region or the low-saturation display region, the method increases the degree of the original pixel values of the input image applied to the process of viewing-angle image compensation.

In FIG. 6, in the beginning of the process such as step S601, a circuit 70 receives an input image from an image memory 77. A control circuit 75 of a display panel 71 is in charge of receiving image signals and processing the signals to be displayed on a display panel 71. The circuit 70 embodies the functions of a viewing-angle image compensation unit 701, a regional frequency detection unit 702 and a saturation detection unit 703.

When the image signals are inputted to the circuit 70, the image signals are temporarily stored to a random access memory 73 such as a static random access memory (SRAM) for implementing a line buffer. As described in the above embodiments, the adjacent pixels will be under consideration when processing the pixels of a line. The random access memory 73 can temporarily store the image data of multiple lines. In step S603, the software-circuit-implemented viewing-angle image compensation unit 701 performs an initial process of viewing-angle image compensation. For example, in FIG. 2, the subpixels of each pixel are arranged sequentially and the viewing-angle image compensation unit 701 makes the subpixels to be in alternating bright-and-dark arrangement such as "bright, dark, bright, dark, bright, etc." or "bright, bright, dark, dark, bright, bright, etc." especially in the display region with large viewing angle. The problem of color shift can therefore be improved.

In step S605, the software-circuit-implemented regional frequency detection unit 702 of the circuit 70 converts the image into a specific color space such as RGB or YUV color space for calculating a change amount of luminance between the pixel and its surrounding pixels. With the YUV color space as an example, Y represents the luminance that can be used to obtain a frequency value of the pixel or a related region. The display region with high frequency can be determined while a frequency distribution of the input image can be obtained. In step S607, a frequency weight with respect to the display region. For example, a greater frequency weight is applied to the display region with higher frequency. The frequency weight is then mapped to the display region to be processed by viewing-angle image compensation. It should be noted that the frequency weight allows the high-frequency display region to not be processed with the conventional viewing-angle image compensation or with a low-degree viewing-angle image compensation for preventing blur effect in the high-frequency display region.

In step S609, the saturation detection unit 703 of the circuit 70 is used to obtain saturation information according to variances among the subpixels of each of the pixels of the input image. A saturation distribution of the image can be obtained. In step S611, a saturation weight can be applied to the display region based on its saturation. For example, a greater saturation weight is applied to the display region with lower saturation. The saturation weight is mapped to the display region to be processed with viewing-angle image compensation. The saturation weight allows the low-saturation display region to not be processed with the conventional viewing-angle image compensation, or with a low-degree viewing-angle image compensation for reducing color bleeding in the low-saturation display region.

After that, in step S613, various frequency weights are assigned to the display regions of the input image according to the frequency distribution. Further, various saturation weights are assigned to the display regions of the input image according to the saturation distribution. A mixing-weight mapping process is then performed. The weights are used to determine the degree of viewing-angle image compensation performed on the display regions and can be adjusted. When finally performing the mixing-weight mapping upon the image, an output image with reduced effect of viewing-angle image compensation on the high-frequency display regions and low-saturation display regions is produced. The display panel 71 then displays the output image.

In conclusion, according to the embodiments of the method of viewing-angle image compensation and the circuit thereof, the high-frequency region, boundary and low-saturation region of the image are detected while processing viewing-angle image compensation for ensuring the image quality. Further, the method of viewing-angle image compensation can prevent blur effect in the high-frequency display region and reduce color bleeding and/or graininess in the low-saturation region.

Furthermore, the method of viewing-angle image compensation and the circuit thereof embodies a mechanism of viewing-angle image compensation that is applied to a flat panel display. The mechanism can also be applied to other types of displays that require compensation of color shift at a large viewing angle for solving the blur effect in the high-frequency display region and color bleeding and/or graininess in the low-saturation display region. The circuit is such as a circuitry of a projector for implementing viewing-angle image compensation while projecting images.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A method for viewing-angle image compensation, comprising:

detecting a frequency distribution of an input image having display regions, and assigning different frequency weights according to frequencies with respect to the display regions ranging from a high-frequency display region to a low-frequency display region;

detecting a saturation distribution of the input image, and assigning different saturation weights to the display regions ranging from a high-saturation display region to a low-saturation display region;

determining degrees for performing viewing-angle image compensation on each of the display regions of the input image according to the respective frequency weights assigned to the display regions and according to the respective saturation weights assigned to the display regions; and generating an output image after performing mixing-weight mapping on the image being processed with the viewing-angle image compensation.

2. The method according to claim 1, wherein, in the method for viewing-angle image compensation, a measure of alternating bright and dark is applied to subpixels of each of pixels of the input image so as to compensate color shift that occurs in a large viewing-angle region.

3. The method according to claim 1, wherein the input image is transformed to a YUV color space that uses a luminance and a chrominance to describe color, and in which the luminance is used as a reference for calculating a frequency value of each of the display regions.

4. The method according to claim 3, wherein luminance of pixels of a first buffered image, luminance of pixels of a second buffered image and luminance of pixels of a third buffered image are obtained from the input image; a first absolute value of a difference between the luminance of the first buffered image and the second buffered image is obtained; and a second absolute value of a difference between the luminance of the second buffered image and the third buffered image is obtained; and a sum of the first absolute value and the second absolute value is the frequency value of the display region of the input image.

5. The method according to claim 4, wherein, by assigning the frequency weights, the high-frequency display region of the input image is not processed with the viewing-angle image compensation.

6. The method according to claim 5, wherein, in the method for viewing-angle image compensation, a measure of alternating bright and dark is applied to subpixels of each of pixels of the input image so as to compensate color shift that occurs in a large viewing-angle region.

7. The method according to claim 1, wherein, a first buffered image, a second buffered image and a third buffered image are obtained from the input image and the pixel values including the subpixels of the red, green and blue of the input image are obtained so as to calculate absolute values of differences of the pixel values of the red, green and blue among the first buffered image, the second buffered image and the third buffered image, wherein a largest difference of the differences is used as a saturation value for each of the display regions.

8. The method according to claim 7, wherein, by assigning the frequency weights, the low-saturation display region of the input image is not processed with the viewing-angle image compensation.

9. The method according to claim 8, wherein, in the method for viewing-angle image compensation, a measure of alternating bright and dark is applied to subpixels of each of pixels of the input image so as to compensate color shift that occurs in a large viewing-angle region.

10. The method according to claim 9, wherein, after assigning the frequency weights and the saturation weights for each of the display regions of the input image, the step of performing mixing-weight mapping on the image being processed with the viewing-angle image compensation further includes:

using a first mixing-weight mapping unit to set up the frequency weight for each of the display regions according to the frequency distribution of the input image; and using a second mixing-weight mapping unit to set up the saturation weight for each of the display regions according to the saturation distribution of the input image, so as to perform mixing-weight mapping upon the output image being processed by the viewing-angle image compensation in order to generate the output image.

11. A circuit for driving a display panel and performing viewing-angle image compensation, comprising:

at least one circuit logistic configured to perform the steps of:

detecting a frequency distribution of an input image having display regions, and assigning different frequency weights according to frequencies with respect to the display regions ranging from a high-frequency display region to a low-frequency display region;

detecting a saturation distribution of the input image, and assigning different saturation weights to the display regions ranging from a high-saturation display region to a low-saturation display region;

determining degrees for performing viewing-angle image compensation on each of the display regions of the input image according to the respective frequency weights assigned to the display regions and according to the respective saturation weights assigned to the display regions; and generating an output image after performing mixing-weight mapping on the image being processed with the viewing-angle image compensation.

12. The circuit according to claim 11, wherein, in the method for viewing-angle image compensation, a measure of alternating bright and dark is applied to subpixels of each of pixels of the input image so as to compensate color shift that occurs in a large viewing-angle region.

13. The circuit according to claim 11, wherein after assigning the frequency weights and the saturation weights for each of the display regions of the input image, the step of performing mixing-weight mapping on the image being processed with the viewing-angle image compensation further includes:

using a first mixing-weight mapping unit to set up the frequency weight for each of the display regions according to the frequency distribution of the input image; and using a second mixing-weight mapping unit to set up the saturation weight for each of the display regions according to the saturation distribution of the input image, so as to perform mixing-weight mapping upon the output image being processed by viewing-angle image compensation in order to generate the output image.

14. The circuit according to claim 11, wherein the input image is transformed to a YUV color space that uses a luminance and a chrominance to describe color, and in which the luminance is used as a reference for calculating a frequency value of each of the display regions; luminance of pixels of a first buffered image, luminance of pixels of a second buffered image and luminance of pixels of a third buffered image are obtained from the input image; a first absolute value of a difference between the luminance of the first buffered image and the second buffered image is obtained; a second absolute value of a difference between the luminance of the second buffered image and the third buffered image is obtained; and a sum of the first absolute value and the second absolute value is the frequency value of the display region of the input image.

15. The circuit according to claim 14, wherein, after assigning the frequency weights and the saturation weights for each of the display regions of the input image, the step of performing mixing-weight mapping on the image being processed with the viewing-angle image compensation further includes:

using a first mixing-weight mapping unit to set up the frequency weight for each of the display regions according to the frequency distribution of the input image; and using a second mixing-weight mapping unit to set up the saturation weight for each of the display regions according to the saturation distribution of the input image, so as to perform mixing-weight mapping upon the output image being processed by viewing-angle image compensation in order to generate the output image.

16. The circuit according to claim 11, wherein, a first buffered image, a second buffered image and a third buffered image are obtained from the input image and the pixel values including the subpixels of the red, green and blue of the input image are obtained so as to calculate absolute values of differences of the pixel values of the red, green and blue among the first buffered image, the second buffered image and the third buffered image, wherein a largest difference of the differences is used as a saturation value for each of the display regions.

17. The circuit according to claim 16, wherein, after assigning the frequency weights and the saturation weights for each of the display regions of the input image, the step of performing mixing-weight mapping on the image being processed with the viewing-angle image compensation further includes:

using a first mixing-weight mapping unit to set up the frequency weight for each display region according to the frequency distribution of the input image; and using a second mixing-weight mapping unit to set up the saturation weight for each display region according to the saturation distribution of the input image, so as to perform mixing-weight mapping upon the output image being processed by viewing-angle image compensation in order to generate the output image.

18. The circuit according to claim 17, wherein, in the method for viewing-angle image compensation, a measure of alternating bright and dark is applied to subpixels of each of pixels of the input image so as to compensate color shift that occurs in a large viewing-angle region.

* * * * *